US011598142B2

(12) United States Patent
Woodward et al.

(10) Patent No.: US 11,598,142 B2
(45) **Date of Patent: *Mar. 7, 2023**

(54) FENESTRATION ASSEMBLIES INCLUDING COMPOSITE FRAME CORES AND METHODS FOR SAME

(71) Applicant: Marvin Lumber and Cedar Company, LLC, Eagan, MN (US)

(72) Inventors: Bradley D. Woodward, Warroad, MN (US); Kyle C. Koch, Warroad, MN (US); Daniel Jon Curtis, Warroad, MN (US); Timothy R. Bentow, Warroad, MN (US); Chris Ylitalo, Warroad, MN (US)

(73) Assignee: Marvin Lumber and Cedar Company, LLC, Eagan, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/447,255

(22) Filed: Sep. 9, 2021

(65) Prior Publication Data

US 2022/0065028 A1 Mar. 3, 2022

Related U.S. Application Data

(63) Continuation of application No. 16/596,702, filed on Oct. 8, 2019, now Pat. No. 11,136,816.

(Continued)

(51) Int. Cl.
*E06B 3/67* (2006.01)
*E06B 3/20* (2006.01)

(Continued)

(52) U.S. Cl.
CPC ..... *E06B 3/6715* (2013.01); *E06B 3/205* (2013.01); *E06B 3/222* (2013.01); *E06B 3/26303* (2013.01); *E06B 3/66304* (2013.01)

(58) Field of Classification Search
CPC ..... E06B 3/6715; E06B 3/205; E06B 3/222; E06B 3/26303; E06B 3/66304
See application file for complete search history.

(56) References Cited

U.S. PATENT DOCUMENTS 4,624,091 A * 11/1986 Biro ..... E06B 3/5821 52/204.593
5,713,167 A * 2/1998 Durham ..... E06B 1/345 52/204.67

(Continued)

FOREIGN PATENT DOCUMENTS

DE 10033389 1/2002

OTHER PUBLICATIONS

"U.S. Appl. No. 16/596,702, Non Final Office Action dated Nov. 12, 2020", 7 pgs.

(Continued)

*Primary Examiner* — Beth A Stephan
(74) *Attorney, Agent, or Firm* — Schwegman Lundberg & Woessner, P.A.

(57) ABSTRACT

A fenestration assembly includes a glazing unit includes a pane spacer between exterior and interior panes proximate glazing unit edges. A fenestration frame is coupled around the glazing unit and includes a frame core extending around the glazing unit. The frame core includes a unitary core wall including a composite material that is hollow and extends continuously from a core interior face to a core exterior face. A metal glazing cap is coupled with the frame core. The metal glazing cap having a cap end indirectly engaged with the glazing unit along the interior pane, and the cap end is remote from the pane spacer. Each of the core exterior face, the pane spacer and the metal glazing cap are thermally isolated from each other with the frame core including the unitary core wall.

24 Claims, 8 Drawing Sheets

Related U.S. Application Data

(60) Provisional application No. 62/742,720, filed on Oct. 8, 2018.

(51) Int. Cl.

| | |
|---|---|
| ***E06B 3/22*** | (2006.01) |
| ***E06B 3/663*** | (2006.01) |
| ***E06B 3/263*** | (2006.01) |

(56) References Cited

U.S. PATENT DOCUMENTS

| | | | | |
|---|---|---|---|---|
| 7,520,093 | B2 * | 4/2009 | Guhl | E06B 3/5454 52/204.52 |
| 8,617,702 | B2 * | 12/2013 | Jha | C08K 7/28 52/656.5 |
| 8,997,412 | B1 * | 4/2015 | Header | E06B 1/18 52/204.71 |
| 9,127,498 | B1 * | 9/2015 | Ye | E06B 3/5821 |
| 9,683,402 | B2 * | 6/2017 | Abdul Lathief | E04F 11/1846 |
| 10,107,027 | B1 * | 10/2018 | Weavers | E06B 3/08 |
| 11,136,816 | B2 | 10/2021 | Woodward et al. | |
| 2009/0277093 | A1 * | 11/2009 | Over | E06B 3/68 49/400 |
| 2017/0240738 | A1 * | 8/2017 | Ehrlichmann | B29C 48/022 |
| 2018/0179805 | A1 * | 6/2018 | Niehausmeier | E05C 1/00 |
| 2020/0109595 | A1 * | 4/2020 | Woodward | E06B 3/66304 |

OTHER PUBLICATIONS

"U.S. Appl. No. 16/596,702, Response filed Mar. 12, 2021 to Non Final Office Action dated Nov. 12, 2020", 14 pgs.

"U.S. Appl. No. 16/596,702, Examiner Interview Summary dated Mar. 16, 2021", 2 pgs.

"U.S. Appl. No. 16/596,702, Notice of Allowance dated Jun. 4, 2021", 7 pgs.

"Canadian Application Serial No. 3,057,928, Office Action dated Dec. 8, 2021", 3 pgs.

"Canadian Application Serial No. 3,057,928, Response Filed Apr. 6, 2022 to Office Action dated Dec. 8, 2021", 82 pgs.

* cited by examiner

FENESTRATION ASSEMBLIES INCLUDING COMPOSITE FRAME CORES AND METHODS FOR SAME

PRIORITY APPLICATION

This application is a continuation of U.S. patent application Ser. No. 16/596,702, filed Oct. 8, 2019, which claims priority to U.S. Provisional Application Ser. No. 62/742,720, filed Oct. 8, 2018, the disclosure of which are incorporated herein in their entireties by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the data and drawings that form a part of this document: Copyright Marvin Cedar Company (d/b/a Marvin Windows and Doors); Warroad, Minn. All Rights Reserved.

TECHNICAL FIELD

This document pertains generally, but not by way of limitation, to fenestration assemblies and lineal components of fenestration assemblies.

BACKGROUND

Fenestration assemblies including window and door fenestration assemblies include one or more frames. For instance, double hung and door fenestration assemblies include panels (e.g., sashes or doors) movably coupled with a peripheral frame. In at least some examples, each of the panels includes its own frame coupled with a glazing unit, such as a pane of glass.

Some examples of fenestration assemblies include frames constructed with aluminum, steel or the like. For instance, lineal aluminum or steel components are cut to length and assembled to form the frame. In other examples, the frames are constructed with vinyl or polyethylene. In a similar manner to metal components, lineal vinyl or polyethylene are cut to length and assembled to form the frame.

Overview

The present inventors have recognized, among other things, that a problem to be solved can include increasing the strength of fenestration assemblies while at the same time also enhancing thermal insulating properties of fenestration assemblies. Fenestration assemblies including metal frames (e.g., aluminum, steel or the like) are robust assemblies that are resistant to warping, fatigue or the like. Accordingly, metal frames are durable and well suited for large fenestration assemblies including windows and doors that warrant additional rigidity to resist warping or fatigue. In extreme temperatures (e.g., summer, winter or other non-seasonal temperature extremes) the thermal conductivities of metal frames readily transmit heat. For instance, in the winter interior heat is readily transmitted to the exterior of a home through the frame or one or more metal components of the assembly including metal pane spacers between multiple panes of glass. While in the summer exterior heat is readily transmitted through the frame (or metal pane spacers) to the interior of the home.

Optionally, insulating foam, fillers or the like are provided within cavities of the metal frames. While providing some thermal insulation, the metal of the frame extends between the interior and exterior and continues to provide a conductive route for heat between the interior and the exterior (e.g., a route having a relatively high overall heat transfer coefficient (U), high thermal conductivity (κ) or the like). The temperature gradients between the exterior and interior of the fenestration assemblies promote heat transfer along the conductive route, and accordingly decrease the efficiency of heating or cooling a space, such as a room, multiple room building or the like.

In some examples, insulation features, such as bars, plates or the like are interposed between interior and exterior metal frame components. The interposing insulation features intercept and throttle conducted heat, and accordingly decrease the overall heat transfer coefficient (U) of the fenestration assembly. The interposing insulation features also interrupt the rigid structure of the fenestration assembly. Instead of a robust metal frame extending throughout the fenestration assembly the insulation feature is sandwiched between thinner component frames, and the overall modulus of elasticity of the fenestration assembly (a characteristic indicating rigidity) is decreased. To offset the decreased modulus of elasticity one or more of the component frames are enlarged (e.g., have a greater depth), wall thicknesses are increased or the like increasing the weight and profile of the fenestration assembly.

Further, the inclusion of interposing insulation features facilitates variations in thermal expansion between separated frame components. Accordingly, during cold or hot temperatures one of the interior or exterior frame components expands at a different rate than the other frame component. In some examples, the differential in expansion generates loud popping noises in a home. And in other examples the expansion differential warps the fenestration assembly or damages the insulating feature or frame components through the application of shear.

In other fenestration assemblies including vinyl or polyethylene frames the overall heat transfer coefficient (U) is improved compared to metal fenestration assemblies. The vinyl or polyethylene frames, however, have a less rigid structure (e.g., smaller Youngs Modulus) than the metal counterpart frames, and accordingly are less suited for larger fenestration assemblies that use structurally robust framing to resist weight based warping or fatigue. Accordingly, the fenestration assemblies are reinforced with increased wall thicknesses, larger profiles or the like that increase the weight and profile of the fenestration assemblies.

The present subject matter helps provide a solution to these problems with a fenestration assembly including a fenestration frame having a frame core that receives a glazing unit therein. The frame core includes a composite material having robust structural characteristics and thermal insulating characteristics. In one example, the frame core includes a polyurethane impregnated with filaments, such as glass fibers. Optionally, the polyurethane (urethane resin) and filaments are produced in a lineal manner through one of pultrusion or extrusion. The frame core including these composite materials includes characteristics, in one example, such as a modulus of elasticity of seven million pounds per square inch (psi) or more, and thermal conductivity (κ) of 4.0 Btu in/(hr ft$^{2}$° F.) or less, 3.0 to 4.0 Btu in/(hr ft$^{2}$° F.), 3.0 Btu in/(hr ft$^{2}$° F.) or the like.

The frame core (one or more of the assembly frame, panel frame or the like) includes a core wall that extends continuously between a core exterior face and a core interior face. The glazing unit is retained between the core exterior and interior faces. The modulus of elasticity (e.g., seven million psi or more) facilitates the use of smaller profiles without structural reinforcements, such as increases in profile sizes or increasing of wall thickness. Further, because of the thermal conductivity of the frame core material (e.g., 4.0 Btu in/(hr $ft^{2}$° F.) or less or the like) the frame core does not require intervening insulating features, such as bars, plates or the like between frame components. Instead, the frame core extends continuously between the core interior and exterior faces, maintains its mechanical characteristics (e.g., seven million psi or more modulus of elasticity), and accordingly maintains a narrow profile while at the same time providing an insulating fenestration assembly. Further, because of the relatively low thermal conductivity of the frame core as well as the other heat diverting and throttling features described herein, the fenestration assembly provides a corresponding and relatively low heat transfer coefficient (e.g., 0.3 or less).

Additionally, example fenestration assemblies described herein couple the glazing unit within the frame core with one or more glazing clamps. The glazing clamps include deflectable arms (e.g., a polymer living hinge or the like) that engage the glazing unit and clamp the glazing unit between the deflectable arms and the frame core (e.g., a core flange). In another example, a glazing cap covers the glazing clamps and provides a clean aesthetically appealing finish to the fenestration assembly. In some examples, the glazing cap is constructed with a metal, such as aluminum, that is formable (machined, extruded, forged or the like) with sharp corners, decorative profiles or the like. The glazing gap is coupled with the frame core proximate the core interior face and coupled over the glazing clamp. The glazing cap optionally couples along the glazing unit with a seal, such as a gasket, weather stripping or the like to provide an insulated coupling between the cap and the glazing unit. In contrast to the metal glazing cap, the glazing clamp includes thermal insulating materials (relative to metal, such as aluminum). The glazing clamp includes a clamp end engaged with the glazing unit, for instance with point loading or linear loading (e.g., along the clamp end edge).

In one example, the frame core described herein (e.g., having a core wall and one or more intervening cavities between the interior and exterior of the assembly) and the glazing clamp are part of a thermal isolation envelope. The thermal isolation envelope thermally isolates features of the assembly that have relatively high thermal conductivities such as metal components, for instance the metal glazing cap described herein and one or more metal pane spacers included with glazing units (e.g., insulated glazing units or IGU, insulated glass or IG) to separate glass panes and form gas or vacuum cavities. The thermal isolation envelope instead directs heat transfer around features having high thermal conductivities (e.g., metal pane spacers, metal glazing caps or the like) and through the frame core. Because the frame core includes one or more of a core wall and intervening frame cavities, is constructed with composite materials having a relatively low thermal conductivities (e.g. 4.0 Btu in/(hr $ft^{2}$° F.) or less) the heat directed through the core walls of the frame core and delivered between the interior and the exterior of the fenestration assembly is throttled to enhance the retention of heat in a building (e.g., in cold weather) and conversely minimize the ingress of heat to the building (e.g., in warm weather). Further, the glazing clamp includes thermal insulating materials, such as polyurethane, polyethylene or the like and is engaged with the glazing unit with point or linear loading to further throttle heat transfer between the glazing unit and the interior portions of the assembly. Additionally, the indirect coupling of the metal glazing gap with an intervening seal, such as a gasket or weather stripping, isolates the metal glazing cap while the glazing clamp provides the majority of the force retaining the glazing unit in place. Accordingly, the thermal isolation envelope of the fenestration assembly thermally isolates the interior of a fenestration assembly from the exterior while at the same time maintaining a mechanically robust assembly having a relatively narrow profile (measured from the inner perimeter adjacent to a daylight opening to the exterior fenestration perimeter proximate the frame of the rough opening). For instance, the thermal isolation envelope facilitates narrow profiles in the context of direct glaze fenestration assemblies of 1.0 to 2.0 inches, casement fenestration assemblies of 2.5 to 3.5 inches, and door assemblies of 3.5 to 5.0 inches. Further, while providing these narrow profiles the wall thickness for the frame core (e.g., extruded or pultruded walls) is between 0.06 and 0.150 inches.

This overview is intended to provide an overview of subject matter of the present patent application. It is not intended to provide an exclusive or exhaustive explanation of the disclosure. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1B:
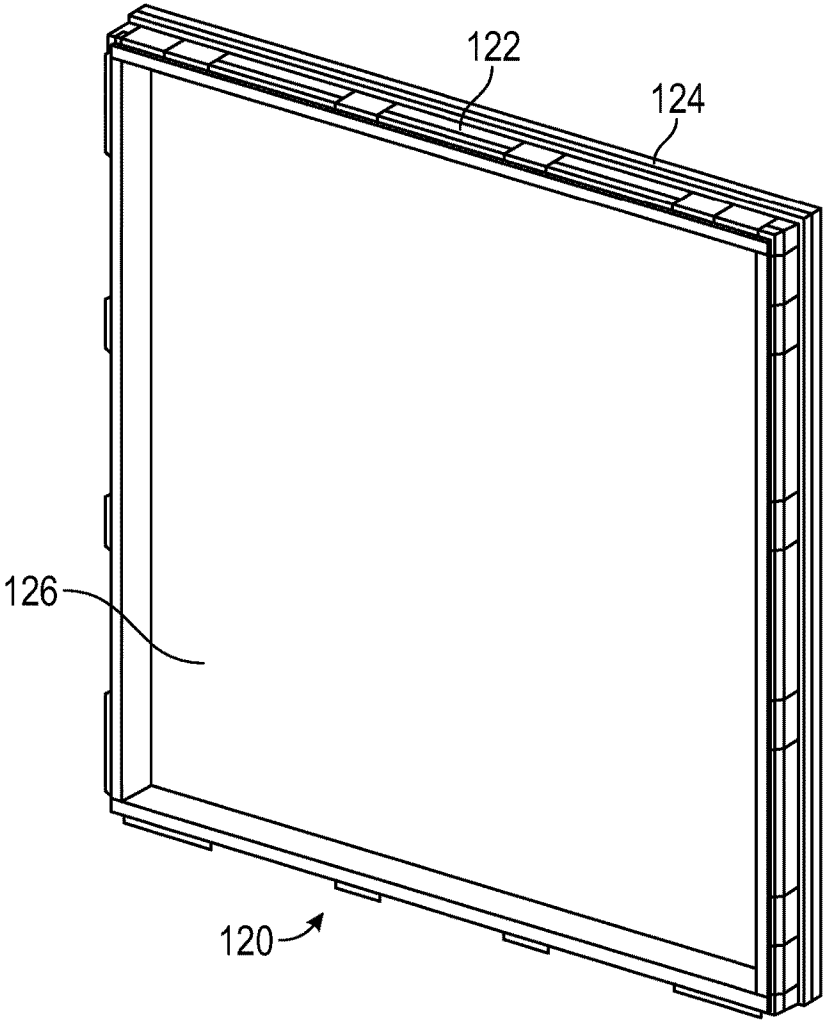
FIG. 1B is a perspective view of another example of a fenestration assembly.
Figure 1A:
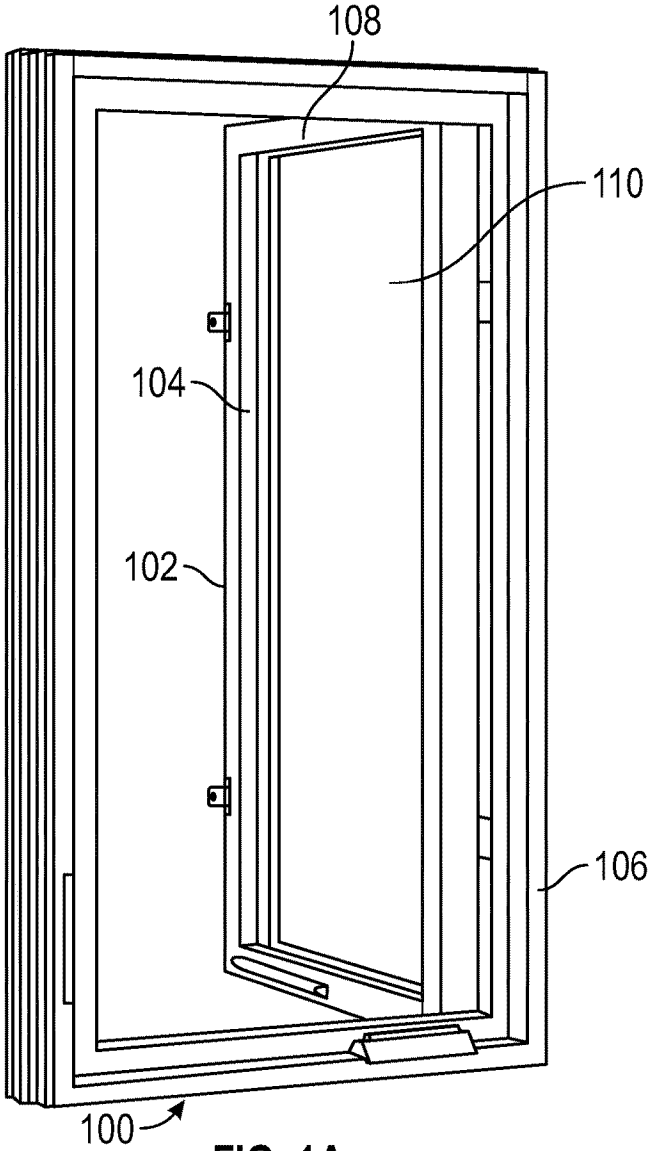
FIG. 1A is a perspective view of one example of a fenestration assembly.

FIG. 1A is a perspective view of one example of a fenestration assembly 100. In this example, the fenestration assembly 100 includes a window assembly having an operable panel, such as the sash 108. The fenestration assembly 100, in this example, is a casement window. In other examples, the fenestration assembly 100 includes, but is not limited to, door assemblies, window assemblies or the like having a moveable or stationary sash or panel. In one example, the sash 108 is a swinging sash such as that shown with the casement window provided in FIG. 1A. In other examples, the sash 108 moves translationally within the peripheral frame 106 of the assembly 100, for instance, in the manner of a single or double hung window.

Referring again to FIG. 1A, the fenestration assembly 100 includes a peripheral frame 106 and a fenestration frame 102 as a component of the sash 108. One or more of the fenestration frame 102 or peripheral frame 106 includes a frame core 104. In various examples, the frame core 104 includes a lineal component such as an extruded or pultruded component having a core wall extending continuously between interior and exterior portions of the fenestration frame 102, peripheral frame 106, sash 108 or fenestration assembly 100. As will be described herein, the frame core 104 isolates one or more components of the fenestration assembly 100 having elevated thermal conductivities. For instance, the frame core 104 isolates one or more pane spacers, panel caps or the like that are, in some examples, constructed with metal and accordingly have thermal conductivities that readily conduct heat in comparison to polymers. The frame core 104 provides a thermal isolation envelope that directs heat transfer away from metal components or other components having greater thermal conductivities and instead diverts heat through the frame core 104 having a relatively low thermal conductivity cin comparison to the metal components. The frame core 104 optionally includes other features that throttle heat transfer including, but not limited to, tortuous core walls, narrow core walls, core cavities (voids) or the like. The direction of heat transfer through the frame core 104 and away from higher thermal conductivity components throttles heat transfer to those components and minimizes heat transfer between the exterior and interior portions of the fenestration assembly 100.

As described herein, the frame core 104 is, in one example, constructed with a polymer having one or more types of filaments. For instance, in one example, the frame core 104 includes a monomer resin such as a urethane resin having glass filaments or fibers included therein. The combination of polymer (e.g., polyurethane) and filaments (e.g., glass filaments) facilitates the production of a frame core 104 having a narrow wall profile that also provides robust structural integrity to the fenestration assembly 100. For example, the frame core 104 includes a Young's modulus of 7,000,000 psi or the like. Additionally, the frame core 104 has a wall thickness of between 0.06 and 0.150 inches while providing example assembly profiles of 1.0 to 2.0 inches for a direct glaze fenestration assembly, 2.5 to 3.5 inches for a casement fenestration assembly, and 3.5 to 5.0 inches for a door fenestration assembly.

Additionally, and as described herein, the frame core 104 constructed with a polymer and one or more filaments included in the polymer provides a thermal conductivity to the fenestration assembly 100 of approximately 3.0 Btu in/(hr ft$^{2}$° F.) or less. In another example, the thermal conductivity for the fenestration assembly 100 includes a thermal conductivity between 3.0 and 4.0 Btu in/(hr ft$^{2}$° F.) and, in still another example, the fenestration assembly 100 includes a thermal conductivity of approximately 4.0 Btu in/(hr ft$^{2}$° F.). The fenestration assembly 100 (and other examples described herein) achieve these thermal conductivities while at the same time maintaining the modulus elasticity of around 7,000,000 psi or more. In another example, the overall heat transfer coefficient (U) of the overall fenestration assembly 100 with the materials described herein is approximately 0.31 or less and is based on the materials used with the frame core 104 as well as components of the frame core (e.g., narrow core walls, tortuous paths between the interior and exterior, cavities or the like).

Referring now to FIG. 1B, another example of a fenestration assembly 100 is shown. In this example, the fenestration assembly 120 includes a direct glaze window assembly including a glazing unit 126 provided therein. A fenestration frame 122, including the frame core 124, extends around the glazing unit 126 and seats the glazing unit 126 therein. In a similar manner, the fenestration assembly 100 previously described and shown in FIG. 1A includes a glazing unit 110 provided, for instance, within the fenestration frame 102 of the sash 108.

Referring again to FIG. 1B, as shown the fenestration assembly 120 includes a frame core 124. The frame core 124, provided in this example, is one example of a peripheral frame corresponding to the peripheral frame 106 shown with the fenestration assembly 100. In contrast, the fenestration frame 122 shown in FIG. 1B directly seats the glazing unit 126 therein. The frame core 124 provides a thermal isolation envelope similar to the frame core 104 shown in FIG. 1A. Accordingly, metal components or other components of the fenestration assembly 120 having higher thermal conductivities are isolated by the minimally thermal conductive frame core 124 and heat transfer is throttled through the fenestration assembly 120, for instance, between the interior and exterior portions. In some examples, the frame core 124 provides a thermal conductivity of approximately 3.0 or 4.0 Btu in/(hr ft$^{2}$° F.), and in another example thermal conductivity between around 3.0 to 4.0 Btu in/(hr ft$^{2}$° F.). Additionally, the frame core 124 provides robust mechanical characteristics previously described with regard to the fenestration assembly 100 (e.g., a Young's modulus of 7,000,000 psi or the like). In both examples, the frame core 124 (and the frame core 104 shown in FIG. 1A) extend from the interior to the exterior portions of the respective fenestration assemblies such as the fenestration assembly 120. Accordingly, the frame core 124 provides a robust structural component for the fenestration assembly 120 while at the same time throttling heat transfer between the interior and exterior of the assembly 120.

Figure 2:
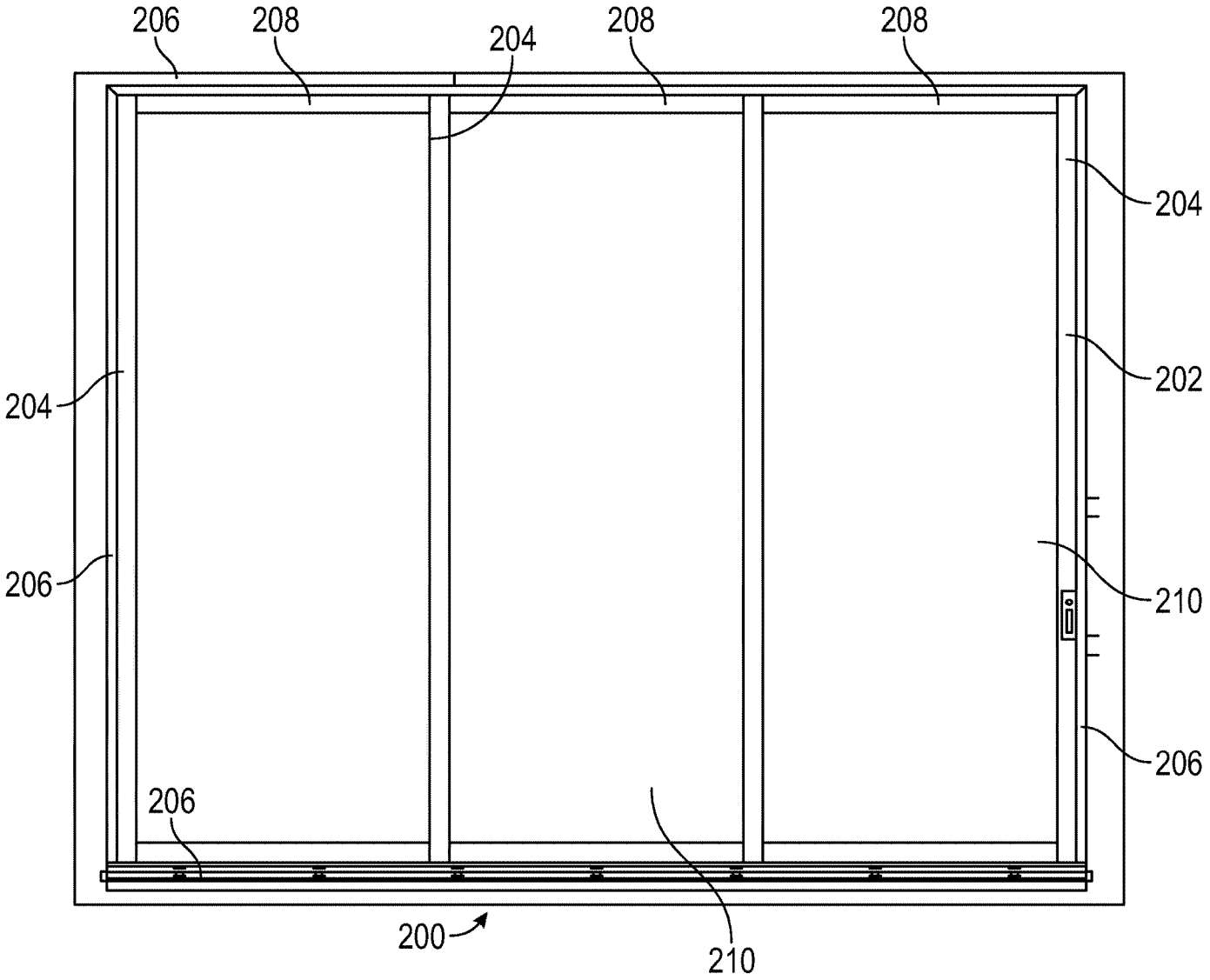
FIG. 2 is a front view of one example of a fenestration assembly including a door.

FIG. 2 is another example of a fenestration assembly 200. In this example, the fenestration assembly includes one or more panels 208, such as doors. The panels 208 are configured to move within the peripheral frame 206. For instance, the panels 208 slide, rotate or the like relative to the peripheral frame 206. As will be described herein, in one example, the panels 208 are slid into a stacked configuration to provide a corresponding large opening through the peripheral frame 106 for pedestrian traffic, ventilation or the like.

As further shown, the fenestration assembly 200 includes one or more glazing units 210 provided in one or more of the panels 208. For instance, a fenestration frame 202 associated with each of the panels 208 surrounds the glazing units 210. As with the previous fenestration assemblies 100, 120, the fenestration assembly 200 includes one or more frame cores 204. In the example shown in FIG. 2, the frame cores 204 are associated with each of the panels 208. In another example, the peripheral frame 206 also includes a frame core similar, in at least some regards, to the frame cores previously described herein. The frame cores 204 include a polymer and one or more filaments configured to provide robust mechanical characteristics to the frame core 204 while at the same time enhancing the thermal insulation characteristics of the frame core 204 and accordingly the fenestration assembly 200 generally.

Figure 3:
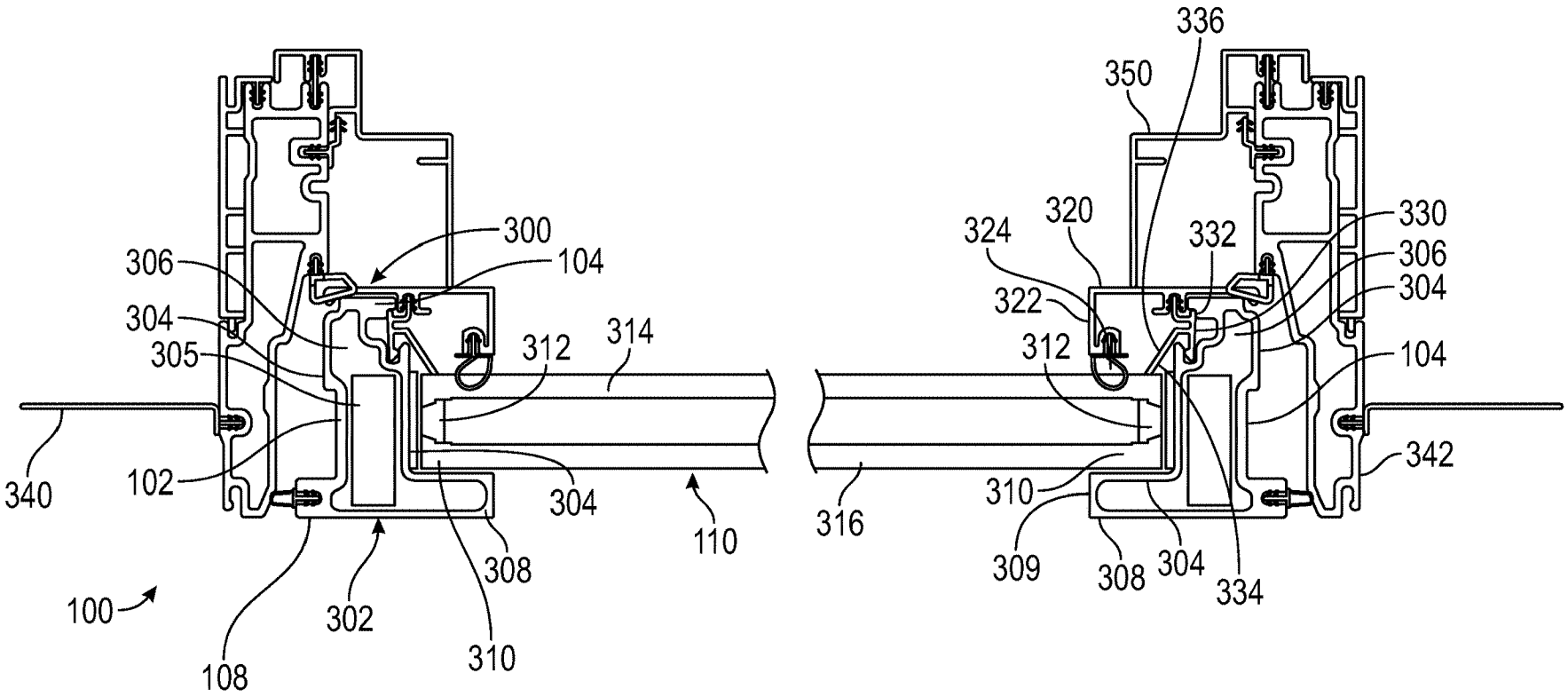
FIG. 3 is a cross sectional view of an example fenestration assembly including at least one frame core.

FIG. 3 is a cross sectional view of the fenestration assembly 100 previously shown in FIG. 1A. As shown in FIG. 3, the fenestration assembly 100 includes a fenestration panel 108 such as a sash, door or the like installed within a peripheral frame such as the peripheral frame 342 corresponding to the peripheral frame 106 shown in FIG. 1A. As further shown in FIG. 3, the fenestration panel 108 includes a frame core 104 including a core wall 304 extending continuously from a core interior face 300 to a core exterior face 302. For instance, the core interior face 300 is proximate to an interior of a home, building or the like while the core exterior face 302 is proximate to an exterior environment relative to the fenestration assembly 100. The frame core 104 includes one or more materials such as, but not limited to, a polymer, filaments or the like. Optionally, the frame core 104 is manufactured in a lineal manner, for instance, in a pultruded or extruded fashion with the core wall 304 providing an enclosed core cavity 306 therein. In another example, an insulation block 305 is installed within the core cavity 306 to further enhance thermal insulation characteristics of the frame core 104.

As further shown in FIG. 3, the fenestration panel 108, in this example, includes a glazing unit 110 installed within the fenestration panel 108. The glazing unit 110, in this example, includes interior and exterior panes 314, 316 with a space there between. As shown in FIG. 3 a pane spacer 312 is installed between the interior and exterior panes 314, 316. The pane spacer 312 is proximate to a glazing unit edge 310 of the glazing unit 110. The pane spacer 312 is optionally a metal component and is isolated by the frame core 104 from other components of the fenestration assembly 100 having relatively high thermal conductivities, such as the glazing cap 320.

As further shown in FIG. 3, the fenestration panel 108 optionally includes a glazing clamp 330 coupled with the frame core 104. The glazing clamp 330, in one example, includes a series of interfitting features such as barbs, projections, flanges, snap fit couplings, fasteners or the like configured to couple with the frame core 104 and one or more other components of the fenestration assembly 100, such as the glazing cap 320. The glazing clamp 330 includes a clamp base 332 coupled with the frame core 104 as well as a deflection arm 336 extending from the clamp base 332 to a clamp end 334. The clamp end 334, in combination with the deflection arm 336, biases the glazing unit 110 toward the seated position shown in FIG. 3. Accordingly the glazing clamp 330 cooperates with a core flange 308 of the frame core 104 to seat and hold the glazing unit 110 in the installed position shown. As described herein, in one example, the clamp end 334 has a limited profile and corresponding engagement with the glazing unit 110. For instance, the clamp end 334 provides a lineal engagement, point engagement (e.g., with a plurality of engaging feet, bosses or the like) or the like with one or more locations of the glazing unit 110 to throttle conductive heat transfer from the glazing unit 110 into the glazing clamp 330.

Referring again to FIG. 3, in another example, the fenestration assembly 100 includes a glazing cap 320 coupled between the frame core 104 and the glazing unit 110. In this example, the glazing cap 320 is coupled with the fenestration frame 102 by way of one or more interfitting features, such as barbs, projections, flanges, snap fit couplings, fasteners or the like. As shown, the glazing cap 320 includes a cap end 322 proximate to the glazing unit 110. In one example, the glazing cap 320 includes a gasket 324, such as a foam gasket, rubber gasket, weather seal or the like, that provides an interface between the glazing cap 320 and the glazing unit 110, for instance, along the interior pane 314. In one example, the glazing cap 320 cooperates with the glazing clamp 330 to provide additional bias to the glazing unit 110 and further enhance the coupling of the glazing unit 110 within the fenestration panel 108.

Optionally, another cap such as a panel cap 350 is, in one example, coupled along the glazing cap 320. In this example, the panel cap 350 is coupled with corresponding portions of the peripheral frame 342. The panel cap 350 along with the glazing cap 320 provides a decorative appearance to the fenestration assembly 100, for instance, proximate to or along the core interior face 300. For instance, as shown in FIG. 3, the glazing cap 320 and the optional panel cap 350 extend over one or more components of the fenestration assembly 100 such as the glazing clamp 330 and interfacing components between the glazing unit 110 and the fenestration frame 102 to provide a clean interface between the fenestration panel 108, the peripheral frame 342 and the glazing unit 110.

The frame core 104 of the fenestration panel 108, as previously described, includes a core wall 304 extending continuously from the core exterior face 302 proximate to an exterior environment to the core interior face 300 proximate to an interior environment. The core wall 304 provides a mechanically robust and continuous structural component extending from the exterior to the interior of the fenestration assembly 100 that supports the remainder of the fenestration assembly 100 without interruptions, for instance for insulation blocking or the like. For example, the frame core 104 provides a structurally robust frame component having a Young's modulus of approximately 7,000,000 psi or more. Additionally, the frame core 104 is constructed with a polymer, such as polyurethane, having one or more types of filaments therein to enhance the overall structural integrity of the frame core 104 and the fenestration assembly 100.

Additionally, the frame core 104 and its associated core wall 304 provides a circuitous path for heat to travel between the core exterior face 302 and the core interior face 300. For instance, the various components of the core wall 304 extend in lateral as well as interior to exterior directions to thereby slow the conduction of heat through the core wall 304 in a tortuous manner. Additionally, each of one or more of metal components of the fenestration assembly 100 such as the glazing cap 320, pane spacer 312 and the like are isolated from each other to thereby further throttle heat transfer through the fenestration assembly 100. For instance, the frame core 104 isolates each of these components from other proximate metal components. As shown, for instance, in FIG. 3, the frame core 104 extends in a continuous fashion from the exterior to the interior and extends around the pane spacer 312 and provides an indirect engagement or interface with the glazing cap 320 by way of the glazing clamp 330 and the gasket 324 coupled along the frame core 104. By disconnecting or isolating each of the glazing cap 320 and the pane spacer 312 from each other, heat accumulated in one of the components or along one or more of the surfaces of the fenestration assembly 100 such as the core interior face 300 or core exterior face 302 remains localized relative to those locations. For example, each of the glazing cap 320 and the pane spacer 312 are isolated from one another. Accordingly a hot exterior environment (e.g., during the summer) proximate to the core exterior face 302 is not readily conducted from the pane spacer 312 to the glazing cap 320 positioned along the interior environment of the building. Instead, the core wall 304 of the frame core 104 is interposed between the pane spacer 312 and the glazing cap 320 to interrupt or throttle heat transfer from the pane spacer 312 to the glazing cap 320 having higher thermal conductivities. Additionally, the glazing clamp 330 previously described herein provides additional isolation of the glazing cap 320 relative to the pane spacer 312 and the glazing unit 110. For instance, the clamp end 334 of the glazing clamp 330 provides a limited conductive engagement along the glazing unit 110 to further throttle heat transfer from the glazing unit 110 such as the pane spacer 312 to other components of the fenestration assembly 100 such as the metal glazing cap 320 coupled with the glazing clamp 330.

In another example, the peripheral frame 342 including, for instance, the installation flange 340 configured for installation by way of fastening or the like to a rough opening of a building is constructed with a frame core similar in at least some regards to the frame core 104 associated with the fenestration panel 108. For instance, the peripheral frame 342 includes a frame core constructed with, but not limited to, a polymer such as polyurethane and interstitial elements such as glass fibers or the like that provide robust mechanical characteristics to the peripheral frame 342 while at the same time throttling heat transfer.

As further shown in FIG. 3, in one example, one or more insulation blocks 305 (e.g., solid blocks, foam inserts, spray foam or the like) are optionally installed within core cavities 306 of the various frame cores 104. For instance, the insulation block 305 associated with the fenestration panel 108 is installed within a core cavity 306 of the frame core 104. In a similar manner, the peripheral frame 342, in another example, includes an insulation block optionally provided in cavities therein. The insulation blocks 305 are intercept heat transmitted by radiation or convention from one portion of the frame core 104 across the core cavity 306 to another portion of the frame core 104. The insulation blocks 305 intercept heat otherwise transferred and further throttle heat transfer from a location of the frame core 104 (e.g., exterior or interior) to other locations (the other of interior or exterior).

Figure 4:
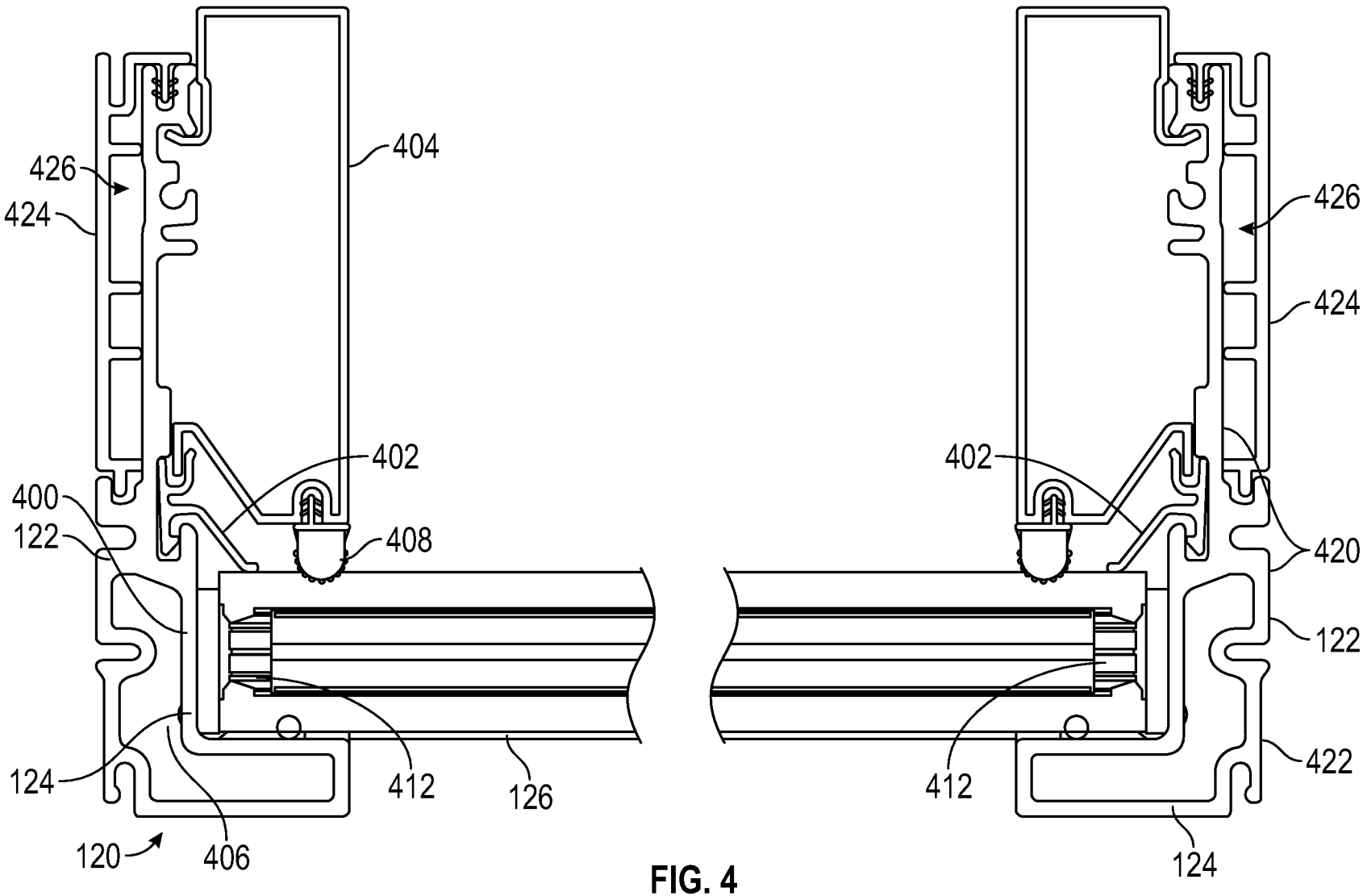
FIG. 4 is a cross sectional view of another example fenestration assembly including at least one frame core.

FIG. 4 is a cross sectional view of the fenestration assembly 120 shown previously in FIG. 1B. The fenestration assembly 120 includes features similar, in some regards, to the fenestration assembly 100 previously shown in FIG. 1A and described in further detail in FIG. 3. For example, the fenestration assembly 120 includes a glazing unit 126 received within a fenestration frame 122. In this example, the fenestration frame 122 is a direct glaze fenestration frame. The fenestration frame 122 includes a frame core 124, such as a polymer and filament filled frame core 124, having a continuous core wall 400 extending between interior and exterior portions of the fenestration assembly 120. As shown in FIG. 4, the core wall 400 extends continuously, for instance, from an exterior side of the glazing unit 126 to an interior side of the glazing unit. As further shown in FIG. 4, the frame core 124 includes a core cavity 406. As with previous examples, the core cavity 406 is optionally filled with an insulation block (e.g., insulation block, foam insulation insert, insulation filling or the like) configured to intercept heat otherwise transferred across the core cavity 406 between the interior and exterior portions. The frame core 124 provides robust structural integrity to the fenestration assembly 120 while at the same time throttling heat transfer between the exterior and interior components of the fenestration frame 122.

As further shown in FIG. 4, the fenestration assembly 120 further includes a glazing clamp 402 similar to the glazing clamp previously described herein. For instance, the glazing clamp 402 includes a deflectable arm that biases the glazing unit 126 toward a corresponding component of the frame core 124, such as a core flange (shown in FIG. 3 and similarly shown in FIG. 4). As further shown in FIG. 4, a glazing cap 404 is provided over the glazing clamp 402 and conceals the glazing clamp 402 and provides a clean aesthetic for the fenestration assembly 120 along the interior surface of the assembly. The glazing cap 404, like the glazing clamp 402, is coupled with the fenestration frame 122, for instance, with one or more recesses, projections or the like. A gasket 408 is optionally provided between the glazing cap 404 and the glazing unit 126 to isolate the glazing cap 404 from the glazing unit 126 and substantially minimize the ingress of moisture, drafts or the like.

As previously described, the frame core 124 provides a thermal isolation envelope that extends continuously from the exterior of the fenestration assembly 120 to the interior of the fenestration assembly 120. The thermal isolation envelope of the frame core 124 isolates components of the fenestration assembly 120 having higher thermal conductivities, such as the pane spacer 412, glazing cap 404 or other components including metal or other higher thermal conductivity materials. The thermal isolation envelope isolates these components and directs heat transfer away from the components, for instance, through the core wall 400. As previously described, the core wall 400 has a narrow cross sectional profile and includes a tortuous route between the interior and exterior portions of the assembly, such as one or more of lateral and vertical (relative to the page) segments, corners or the like to provide a circuitous route for heat transfer between the interior and exterior portions. Additionally, the core cavity 406 further minimizes heat transfer by providing a void between the interior and exterior portions. Optionally the core cavity is filled with an insulation block that intercepts heat transfer across the core cavity 406 from convection or radiation and thereby further throttles heat transfer through the frame core 124. In contrast to fenestration assemblies having insulating bars, plates or the like interposed between interior and exterior metal frame components, the frame core 124 described herein is itself a thermally insulating component that extends between interior and exterior portions of the assembly and diverts heat transfer away from high thermal conductivity components, and also provides a continuous structural framework for the assembly 120.

As further shown in FIG. 4, the fenestration frame 122, in this example, includes a step perimeter portion 420, for instance, along a peripheral portion of the fenestration frame 122. As shown, the step perimeter portion 420 includes a step surface 422 that projects (or stands proud) relative to a mullion recess 426 provided along the step perimeter portion 420. As shown in FIG. 4, a shim block 424 is coupled with the fenestration frame 122 and positioned within the mullion recess 426. The shim block 424 fills the mullion recess 426 and provides a flush surface across the peripheral portion of the frame 122. The flush surface facilitates the installation of the fenestration assembly 120 in a rough opening of a building. As will be described herein, in one example, the step perimeter portion 420 including its mullion recess 426 and associated projections, grooves or the like shown in FIG. 4 are, in various examples, components of a mullion system, such as the mullion system 700 shown in FIG. 7.

Figure 5:
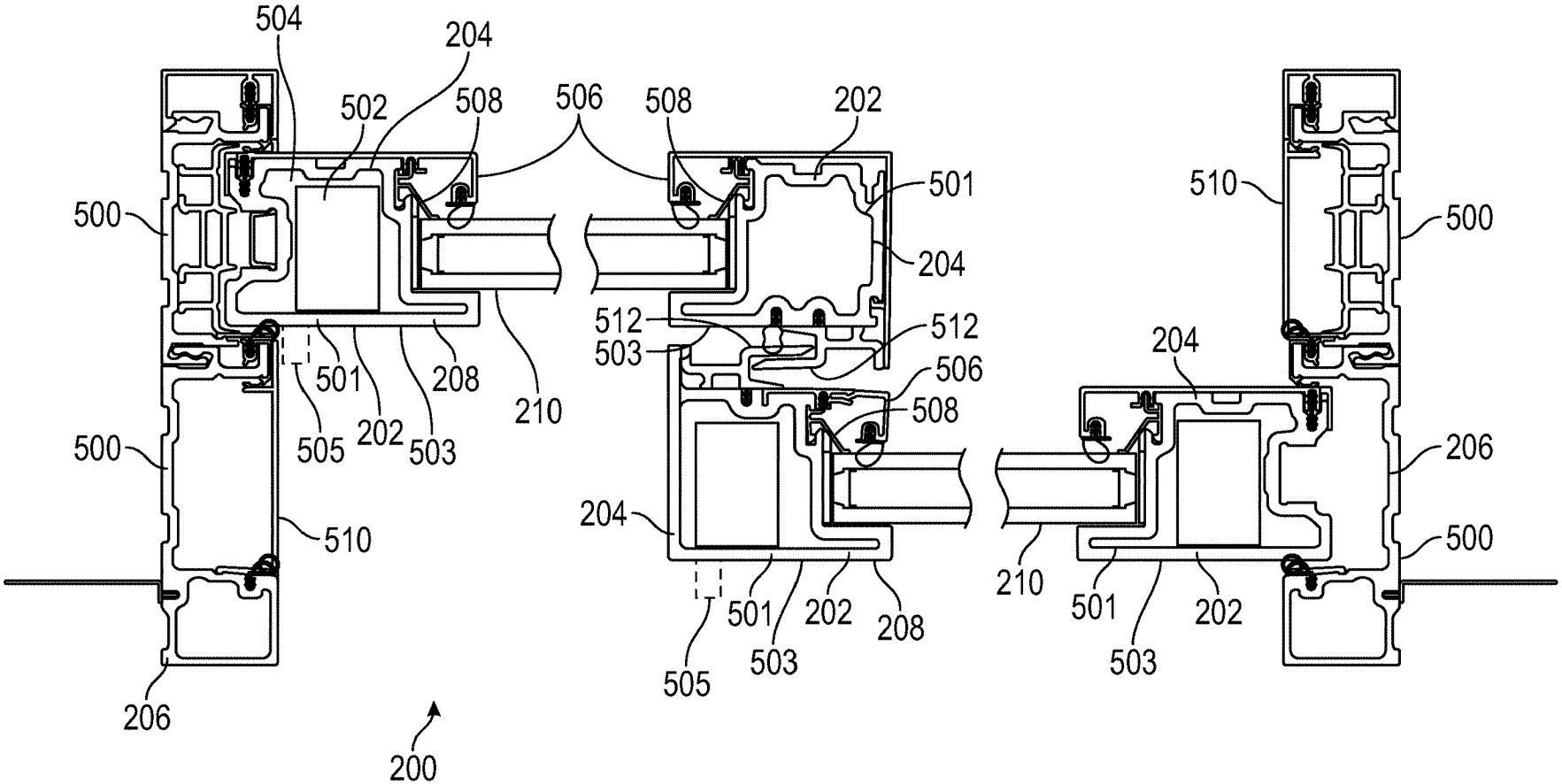
FIG. 5 is a cross sectional view of an additional example fenestration assembly including at least one frame core.

FIG. 5 is another example of a fenestration assembly 200 corresponding to the door assembly shown in FIG. 2. In the example shown in FIG. 5 the fenestration assembly 200 includes two panels 208 (in contrast to the three shown in FIG. 2). The panels 208, such as door panels, are moveable within the peripheral frame 206. In the example shown in FIG. 5, the panels 208 are slidably moveable within the peripheral frame 206, for instance, along one or more tracks, with bogie wheels or the like. The panels 208 are provided in a deployed configuration (e.g., closed). The nesting anchors 512 and other components of the panels 208 shown in FIG. 5 facilitate the use of additional panels 208 such as the third panel shown in FIG. 2 as well as additional panels coupled in series as described herein.

As shown in FIG. 5, each of the panels 208 includes a fenestration frame 202 and associated glazing unit 210 seated within the fenestration frame 202. In this example, the panels 208 include one or more components similar to previously described components including, but not limited to, frame cores 204 having corresponding core walls 501 that extend between interior and exterior portions of the respective panels 208. The frame cores 204 are, in one example, constructed with a composite material including, for instance, a polymer and one or more added filaments within the polymer. For instance, the frame core 204 is, in one example, constructed with a polyurethane resin mixed with filaments including, but not limited to, glass fibers. As shown in FIG. 5, the frame core 204 optionally includes a core cavity 504 and insulation blocks 502 optionally provided within the core cavity 504. As further shown in FIG. 5, the glazing unit 210 is, in one example, coupled between a component of the fenestration frame 202 such as a core flange 503 and a corresponding component coupled with the fenestration frame 202 such as a glazing clamp 508. An optional glazing cap 506 is, in this example, coupled over the glazing clamp 508 and conceals the glazing clamp 508 to provide a clean aesthetic appearance to the interior portions of each of the panels 208 and the assembly 200 generally.

As previously described, each of the panels 208, in this example, includes a frame core 204. In a similar manner, the peripheral frame 206 of the fenestration assembly 200 also includes one or more frame cores having a similar composition to the panels 208 and accordingly providing robust mechanical characteristics described herein as well as throttling heat transfer between the exterior and interior.

The fenestration assembly 200, shown in FIG. 5, further includes, in one example, a series of component frames 500 as the peripheral frame 206. As shown, the component frames 500 are associated with respective panels 208 of the fenestration assembly 200. The component frames 500 are coupled with each other to stack successive panels 208 and form the fenestration assembly 200. The peripheral frame 206 having the plural component frames 500 thereby provides a unitary assembled frame (the peripheral frame 206) surrounding the associated panels 208. As further shown in FIG. 5, each of the component frames 500 are coupled in series to accordingly provide an overall composite fenestration assembly 200 configured to carry multiple panels 208 in the telescoping stacked configuration shown in FIG. 5.

Optionally, the component frames 500 include panel caps 510 configured to extend across one or more cavities, recesses or the like otherwise provided in the component frame 500 for reception of a portion of the corresponding panel 208. For instance, as shown in FIG. 5, the lower left portion of the peripheral frame 206 includes a panel cap 510 extending across a recess. In a similar manner, a panel cap 510 is provided across the component frame 500 on the upper right and opposed to the panel 208 in the closed position to the left. The panel caps 510 provide a decorative aesthetically clean appearance to the corresponding component frames 500.

As further shown in FIG. 5, each of the panels 208, in this example, include optional nesting anchors 512. As shown, the nesting anchors 512 are provided between the panels 208 to accordingly facilitate the telescoping movement of the panels 208, for instance, when moving from the open to the closed position. For instance, with the upper panel 208, shown in FIG. 5, in an open position (positioned to the right of its current position), the nesting anchors 512 are disengaged and spaced from each other because the upper panel 208 is stacked over the lower panel 208. As the panel 208 is closed, for instance, moved from the right to the left portion of FIG. 5, the nesting anchor 512 of the upper panel 208 engages with the corresponding portion of the nesting anchor 512 to provide an interfit between each of the panels 208. Further, in a system similar to that shown in FIG. 2 including, for instance, a fenestration assembly 200 having a plurality of panels 208, such as three or more panels 208, the nesting anchors 512 engage as a leading panel 208 is moved. The nesting anchor 512 of the leading panel couples with the nesting anchor 512 of the next panel 208, and the next panel 208 is telescopically deployed with the leading panel 208, Accordingly the panels 208 in a stacked configuration (e.g., while open) interfit with one another to deploy in a staggered telescoping manner through coupling of each of the nesting anchors 512. In another example, the panels 208 include opposed nesting flanges 505 (e.g., bumpers, projections or the like) shown in broken lines in FIG. 5 that couple with a portion of adjacent panels 208 to telescopically open each of the panels successively with opening movement of a preceding panel 208.

Figure 6:
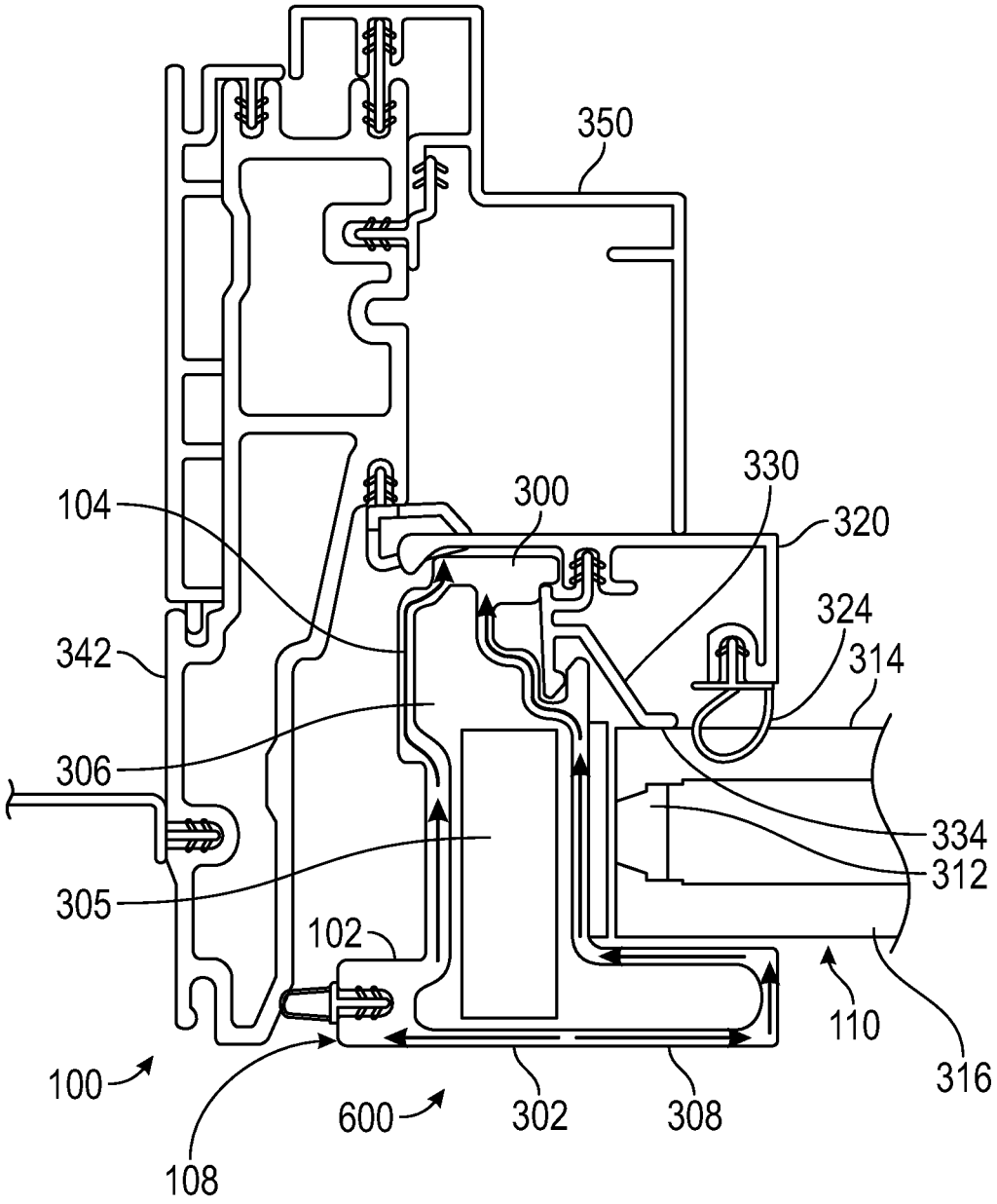
FIG. 6 is a detailed schematic view of a portion of fenestration assembly of FIG. 3 including an example thermal isolation envelope.

FIG. 6 is a detailed cross sectional view of a portion of the fenestration assembly 100 previously shown and described in FIG. 3. In this portion of the fenestration assembly 100, the panel 108 and a portion of the peripheral frame 342 are shown in a coupled configuration, for instance, with the panel 108 closed relative to the peripheral frame 342. The panel 108 includes a sash or door panel, for instance, of a casement window, double hung window, door system or the like. As previously described, a glazing unit 110 including an interior pane 314 and an exterior pane 316 is seated within the panel 108 along a core flange 308. In this example, a glazing clamp 330 coupled with the frame core 104 of the fenestration frame 102 applies a bias to the glazing unit 110, for instance, along the interior pane 314 to bias the glazing unit 110 into the seated position. As further shown in FIG. 6, a glazing cap 320 and optionally a panel cap 350 are coupled with portions of the fenestration assembly 100 including, for instance, the panel 108 and peripheral frame 342, respectively. As previously described, the glazing cap 320 and the pane spacer 312 and similar components having higher thermal conductivities (e.g., relative to the frame core) are thermally isolated by the frame core 104 of the fenestration frame 102. For instance, the frame core 104 includes a thermal isolation envelope 600 shown with arrows indicating heat transfer extending through the core wall 304 of the fenestration frame 102 and directed around (and thereby away from) the pane spacer 312 and the panel cap 320.

The thermal isolation envelope 600 shown in FIG. 6 includes illustrative arrows extending through the core wall 304 of the frame core 104. The arrows correspond to heat transferred or directed through the frame core 104, in this example, from the core exterior face 302 toward the core interior face 300. In this example, the fenestration assembly 100 is, in one example, installed in a building with a warmer environment on the exterior face 302 relative to the core interior face 300, for instance during summer months. Accordingly, heat is transferred indirectly by way of the thermal isolation envelope 600 through the frame core 104 toward the core interior face 300. The tortuous path through the frame core 104, for instance, corresponding to the arrows extending laterally and vertically (relative to the page) in combination with the material and dimensions (e.g., width) of the core wall 304 throttles heat transfer toward the core interior face 300. Additionally, the frame core 104 isolates one or more components of the fenestration assembly 100 having relatively higher thermal conductivities compared to the frame core 104. Examples of components having higher thermal conductivities include the pane spacer 312 provided with the glazing unit 110 as well as one or more or the panel cap 350, glazing cap 320 or the like. The thermal isolation envelope 600 thermally isolates each of these features and accordingly minimizes the transfer of heat between them. Instead, the thermal isolation envelope 600 of the provides a tortuous path that directs heat transfer away from (e.g., around) these components, and directs heat transfer in a circuitous or serpentine path and along the narrow profile of the core wall 304.

As further shown in FIG. 6, the glazing cap 320, in this example, is isolated from the glazing unit 110, for instance, with a gasket 324. Additionally, the glazing cap 320 is coupled with the frame core 104 along the core interior face 300 and accordingly remote relative to the core exterior face 302. Accordingly, heat transferred through the frame core 104 is first directed through the frame core 104 along the tortuous path from the exterior face 302 to the interior face 300 before reaching the glazing cap 320 coupled at the remote end of the core interior face 300 of the frame core 104.

As further shown in FIG. 6, the thermal isolation envelope 600 further includes the core cavity 306 extending through the frame core 104, for instance, from the core exterior face 302 to the core interior face 300. The core cavity 306 provides a void within the frame core 104 that further throttles heat transfer. Heat is preferentially directed by conduction through the core wall 304 having the tortuous path described herein, and is transferred across the core cavity 306 through radiation or convection (generally slower forms of heat transfer relative to conduction). In some examples, an insulation block 305 (a block of insulation, foam insert, spray foam or the like) is provided within the core cavity 306 to intercept incidental heat transmitted between the core exterior face 302 and the core interior face 300 across the core cavity 306.

In another example, the thermal isolation envelope 600 throttles heat transfer in the converse direction, for instance, from the core interior face 300 toward a cooler core exterior face 302 (e.g., in winter). In this example, the heat transfer from the core interior face 300 toward the core exterior face 302 is also throttled by way of the tortuous path through the core walls 304 of the frame core 104. Additionally, each of the components of the fenestration assembly 100 having higher thermal conductivities than the frame core 104, such as the glazing cap 320 and pane spacer 312, remain isolated from heat transfer otherwise directed through the thermal isolation envelope 600.

Figure 7:
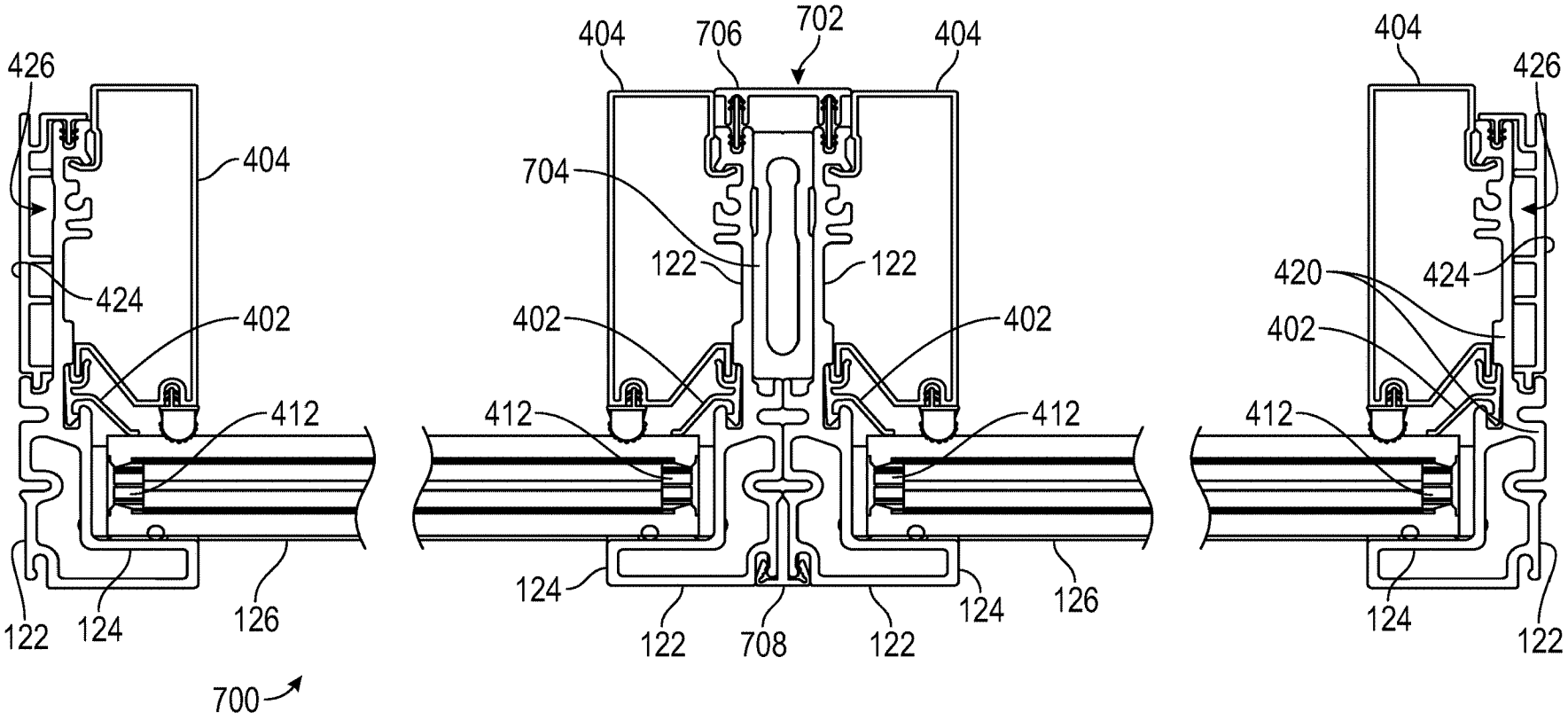
FIG. 7 is a cross sectional view of a plurality of fenestration assemblies including a mullion system coupled therebetween.

FIG. 7 is a cross sectional view of another example of a fenestration assembly 700. The fenestration assembly 700 includes a plurality of fenestration assemblies such as the fenestration assembly 120 shown in FIG. 4. As previously described, the fenestration assembly 120 and the component corresponding fenestration assemblies of the assembly 700 shown in FIG. 7 include respective glazing units 126 as well as fenestration frames 122 that seat the glazing unit 126 therein. The fenestration frames 122 include frame cores 124 having core walls extending between the interior and exterior portions of the fenestration assembly 700. As shown in FIG. 7, the frame cores 124 provide a continuous core wall that extends from an exterior portion of the fenestration assembly 700 (corresponding to the lower portion of the view) and an interior portion (corresponding to the upper portion of the view) shown in FIG. 7.

As further shown, the glazing unit 126 is, in one example, coupled in place within the fenestration assembly 700 with a glazing clamp, such as the glazing clamp 402 shown in FIG. 7 and previously described in FIG. 4. Additionally, each of the two component assemblies of the fenestration assembly 700 include shim blocks 424 installed within mullion recesses 426 along the perimeter of the fenestration assembly 700. As further shown in FIG. 7, in one example, glazing caps 404 are coupled over the glazing clamps 402 and provide a decorative or aesthetic appearance to the fenestration assembly 700 along the interior portions of the assembly.

As previously described, one or more components of the fenestration assembly 700 are metal, for instance, one or more of pane spacers 412, the glazing cap 404 or the like. Frame cores 124 of the fenestration assembly 700 are constructed, in one example, with composite materials including, for instance, a polymer resin such as urethane and one or more filaments included with the resin such as glass fibers or the like. The frame core 124 provides a mechanically robust framework extending between the interior and exterior portions of fenestration assembly 700 while at the same time also minimizing heat transfer with the frame core 124 between the interior and exterior portions of the fenestration assembly 700.

As further shown in FIG. 7, the fenestration assembly 700, in this example, includes a mullion system 702 bridging between the component fenestration assemblies of the assembly. For instance, the mullion system 702, in one example, includes one or more components of the component fenestration assemblies including, for instance, the stepped perimeter portion 420 and the mullion recess 426. As shown toward the middle of the fenestration assembly 700, in this example, each of the mullion recesses 426 are left open and a mullion block 704 is installed therein. In one example, the mullion block 704 provides a structural interface between the fenestration frames 122 of the component fenestration assemblies of the assembly 700 shown in FIG. 7.

In another example, the mullion system 702 includes one or more mullion caps configured to provide an interface between the component fenestration assemblies. For instance, as shown in FIG. 7, a mullion cap 706 bridges across the respective fenestration frames 122 of the component fenestration assemblies and accordingly provides a continuous interface therebetween. In a similar manner along the exterior portion of the fenestration assembly 700, another mullion cap 708 bridges between the fenestration assembly 722 and thereby provides a continuous smooth interface between the component assemblies of the fenestration assembly 700. The mullion system 702 thereby provides a structural and optionally aesthetic interface between the component fenestration assemblies of the fenestration assembly 700. The fenestration assembly 700 having the mullion system thereby provides the appearance of a continuous fenestration unit extending across a plurality of fenestration frames 122.

Figure 8:
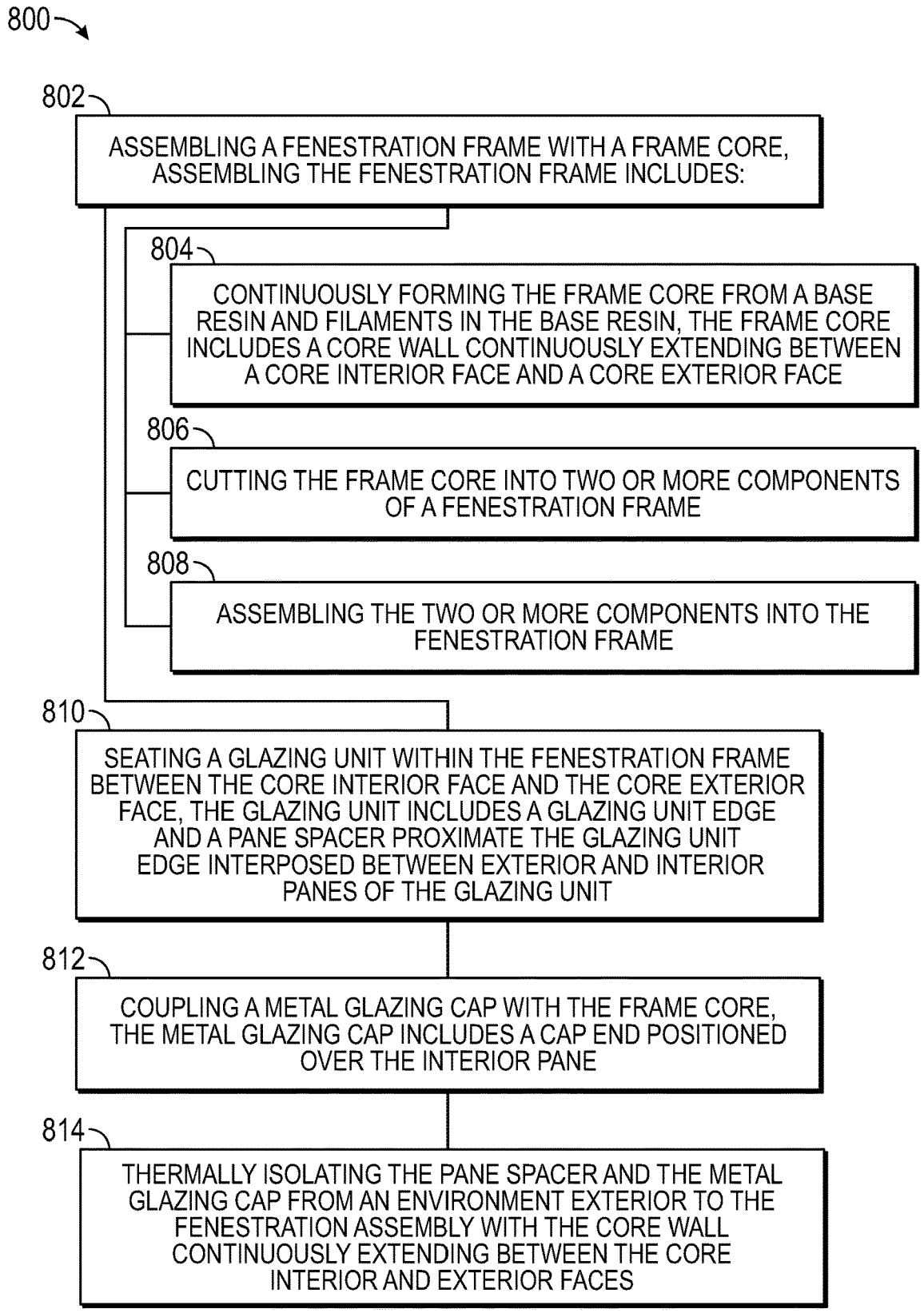
FIG. 8 is a block diagram showing one example of a method making a fenestration assembly.

FIG. 8 shows one example of a method 800 for making a fenestration assembly, such as one or more of the fenestration assemblies described herein. In describing the method 800 reference is made to one or more components, features, functions, steps or the like described herein. Where convenient reference is made to the components, features, functions, steps or the like with reference numerals. Reference numerals provided are exemplary and are not exclusive. For instance, the features, components, functions, steps and the like described in the method 800 include, but are not limited to, the corresponding numbered elements, other corresponding features described herein, both numbered and unnumbered as well as their equivalents.

At 802, a fenestration frame 102 (either or both of a frame of a sash, panel or peripheral frame of the assembly) is assembled including a frame core 104. The frame core 104 includes a composite material. At 804 assembling the fenestration frame includes forming the frame core 104 from a base resin (e.g., monomer resins, such as a urethane resin) and filaments in the base resin. The frame core 104 includes a core wall 304 that continuously extends between a core interior face 300 and a core exterior face 302. As previously described herein the frame core 104 and the core wall 304 are constructed with the composite material. Optionally, the frame core 104 is formed in a continuous process including one or more pultrusion or extrusion. At 806 the frame core 104 is cut (e.g., with a band saw or other cutting device) to provide two or more components of the fenestration frame 102. At 808, the components of the frame core 104 are assembled to form the fenestration frame 102. For instance, the components are fastened together at corners or the like with one or more of welds, adhesives, fittings or the like.

At 810, the method 800 includes seating a glazing unit 110 within the fenestration frame 102 between the core interior face 300 and the core exterior face 302. As shown in FIG. 3, the glazing unit 110 includes a glazing unit edge 310 and at least one pane spacer 312 proximate to the edge 310 and interposed between interior and exterior panes 314, 316 of the glazing unit 110. As shown herein, the interior and exterior panes optionally include translucent panes that permit the passage of daylight through the fenestration assembly 100. The pane spacer 312 spaces the translucent panes and facilitates the interposing of one or more gases (such as Argon or the like) to enhance thermal resistance across the glazing unit 110.

At 812 a glazing cap 320 is coupled with the frame core 104. One example of a glazing cap 320 is shown in FIG. 3. Optionally, the glazing cap 320 includes a metal to provide a specified aesthetic appearance along the core interior face 300. A cap end 322 of the glazing cap 320 is positioned over the interior pane 314 of the glazing unit 110. As described herein, the glazing cap 320 including the cap end 322 engages with the glazing unit 110 and provides a clean corner interface with the glazing unit 110. The glazing cap 320 is optionally metal and indirectly coupled with the glazing unit 110, for instance with an intervening rubber or foam gasket 324. The opposed end of the glazing cap 320 is coupled with the fenestration frame 102, for instance proximate to a core interior face 300.

Optionally, the fenestration assembly 100 includes a glazing clamp 330 that bridges between the fenestration frame 102 and the glazing unit 110 and enhances the coupling of the glazing unit 110 with the fenestration frame 102. As shown in FIG. 3, the glazing clamp 330 is concealed by the glazing cap 320 to enhance the clean lines of the fenestration assembly 100.

At 814 the method 800 includes thermally isolating one or more of the pane spacer 312 and the glazing cap 320 (both are optionally metal) from an exterior environment relative to the fenestration assembly 100. For example, the core wall 304 of the frame core 104 includes a polymer, such as polyurethane, in combination with filaments, such as glass fibers, to enhance the strength of the frame core 104. Additionally, the composite frame core 104 isolates metal components of the fenestration assembly 100 that otherwise readily transfer heat between the exterior and the interior. As described herein, the frame core 104 provides a thermal isolation envelope 600 that throttles heat transfer through the core wall 304 and instead directs heat transfer along tortuous paths, shown in FIG. 6. Additionally, the thermal isolation envelope isolates components having higher thermal conductivities such as the pane spacer 312 and the glazing cap 320 that, if interconnected, would otherwise facilitate heat transfer between the interior and exterior of the fenestration assembly 100. The frame core 104 instead directs heat through the core wall 304 and a core cavity 306. The core wall 304 extends continuously between the core interior face 300 and the core exterior face 302 and, along with the void provided by the core cavity 306, minimizes (e.g., including eliminating or minimizing) heat transfer through metal components, such as the glazing cap 320 or the pane spacer 312.

Several options for the method 800 follow. In one example, fastening the glazing unit 110 within the fenestration frame 102 includes coupling a clamp base 332 of the glazing clamp 330 with the frame core 104. A clamp end 334 of a deflection arm 336 of the clamp 330 is engaged with the glazing unit 110. The deflection arm 336 (e.g., a polymer or other elastically deflectable material) is deflected when engaged with the glazing unit 110, and the glazing unit 110 is clamped between the frame core 104 and the glazing clamp 330 based on the engagement and deflection. In another example, the glazing clamp 330 is concealed with the glazing cap 320. For instance, the glazing cap extends over the glazing clamp 330. Optionally, thermally isolating at least the pane spacer 312 includes coupling a clamp end 334 having a relatively small profile (e.g., point or lineal contact with the glazing unit 110) to throttle heat transfer between the glazing clamp 330 and components of the glazing unit 110, such as a metal pane spacer 312.

In another example, the method 800 includes forming a core flange 308 of the frame core 104, and the core flange 308 extends from a flange end 309 to the remainder of the frame core 104. The glazing unit 110 is seated within the fenestration frame 102. For example, an exterior pane 316 of the glazing unit 110 is seated along the core flange 308.

VARIOUS NOTES & EXAMPLES

Example 1 can include subject matter such as a fenestration assembly comprising: a glazing unit including one or more translucent panes, the glazing unit having an exterior pane and an interior pane, the glazing unit extends between glazing unit edges and includes a pane spacer between the exterior and interior panes proximate the glazing unit edges; and a fenestration frame coupled around the glazing unit, the fenestration frame includes: a frame core extending around the glazing unit, the frame core includes: a unitary core wall including a composite material, the unitary core wall is hollow and extends continuously from a core interior face to a core exterior face; and a core flange as part of the core wall, the core flange proximate the core exterior face, the core flange extends over at least a portion of the pane exterior, the core flange including a flange end remote from the pane spacer; a metal glazing cap coupled with the frame core, the metal glazing cap having a cap end indirectly engaged with the glazing unit along the interior pane, the cap end remote from the pane spacer; and wherein each of the core exterior face, the pane spacer and the metal glazing cap are thermally isolated from each other with the frame core including the unitary core wall.

Example 2 can include, or can optionally be combined with the subject matter of Example 1, to optionally include wherein the frame core is a unitary component including the composite material, and the composite material includes a filament reinforced polymer extending continuously between the core exterior face and the core interior face.

Example 3 can include, or can optionally be combined with the subject matter of one or any combination of Examples 1 or 2 to optionally include wherein the filament reinforced polymer is a glass filament reinforced polyurethane.

Example 4 can include, or can optionally be combined with the subject matter of one or any combination of Examples 1-3 to optionally include wherein the frame core is a unitary component including a filament reinforced polymer having a modulus of elasticity of at least 7 million pounds per square inch.

Example 5 can include, or can optionally be combined with the subject matter of one or any combination of Examples 1~4 to optionally include wherein the frame core is a unitary component including a filament reinforced polymer having a modulus of elasticity of at least 7 million pounds per square inch and a thermal conductivity of 4.0 (Btu in)/(hr ft$^{2}$° F.) or less.

Example 6 can include, or can optionally be combined with the subject matter of Examples 1-5 to optionally include wherein the frame core is a unitary component including a filament reinforced polymer having a thermal conductivity between 3.0 to 4.0 (Btu in)/(hr ft$^{2}$° F.).

Example 7 can include, or can optionally be combined with the subject matter of Examples 1-6 to optionally include wherein the frame core is a pultruded frame core including the filament reinforced polymer.

Example 8 can include, or can optionally be combined with the subject matter of Examples 1-7 to optionally include a glazing clamp coupled with the frame core, the glazing clamp includes: a clamp base, a deflection arm extending from the clamp base to a clamp end, and wherein the glazing unit is clamped between the clamp end of the glazing clamp and the core exterior face.

Example 9 can include, or can optionally be combined with the subject matter of Examples 1-8 to optionally include a glazing clamp having a small profile clamp end including a polymer, and the small profile clamp end is engaged with the glazing unit with one or more of point or lineal contact.

Example 10 can include, or can optionally be combined with the subject matter of Examples 1-9 to optionally include wherein the small profile clamp end having one or more of point or lineal contact with the glazing unit is configured to thermally isolate the frame core including the unitary core wall from the glazing unit and the pane spacer.

Example 11 can include, or can optionally be combined with the subject matter of Examples 1-10 to optionally include wherein the metal glazing cap includes: the cap end, a cap plate extending over the glazing clamp to the cap end, and wherein the glazing cap conceals the glazing clamp.

Example 12 can include, or can optionally be combined with the subject matter of Examples 1-11 to optionally include wherein the core flange includes a flange plate proximate the core exterior face, the flange plate extends over the glazing unit from at least one of the glazing unit edges to the flange end, the flange end laterally spaced from the at least one glazing unit edge.

Example 13 can include, or can optionally be combined with the subject matter of Examples 1-12 to optionally include wherein the flange plate extends across a portion of the pane exterior surface and covers the at least one glazing unit edge.

Example 14 can include, or can optionally be combined with the subject matter of Examples 1-13 to optionally include wherein the fenestration assembly includes at least one of a door assembly or a window assembly.

Example 15 can include, or can optionally be combined with the subject matter of Examples 1-14 to optionally include a fenestration assembly comprising: a peripheral frame having a peripheral frame core, the peripheral frame core includes a hollow peripheral core wall including a first composite material; at least one panel movably coupled with the peripheral frame, the at least one panel includes: a glazing unit having a pane exterior surface and a pane interior surface extending between glazing unit edges, the pane exterior and interior surfaces separated with a pane spacer; a panel frame including a unitary panel frame core coupled around the glazing unit, the unitary panel frame core having a hollow panel core wall including a second composite material extending continuously between a core interior face and a core exterior face; and a metal glazing cap coupled with the hollow panel core wall, the metal glazing cap having a cap end positioned over the pane interior surface; and wherein the at least one panel includes a thermal isolation envelope extending around the pane spacer and the metal glazing cap, the thermal isolation envelope includes: the unitary panel frame core extending continuously between the core interior and core exterior faces; and wherein the thermal isolation envelope thermally isolates each of the core exterior face, the pane spacer and the metal glazing cap, directs heat transfer around the pane spacer and the metal glazing cap and through the unitary frame core, and throttles the directed heat transfer through the hollow panel core wall.

Example 16 can include, or can optionally be combined with the subject matter of Examples 1-15 to optionally include wherein one or more of the first or second composite materials includes a glass filament reinforced polyurethane.

Example 17 can include, or can optionally be combined with the subject matter of Examples 1-16 to optionally include wherein one or more of the first or second composite materials includes a filament reinforced polymer having a modulus of elasticity of at least 7 million pounds per square inch and a thermal conductivity of 4.0 (Btu in)/(hr ft$^{2}$° F.) or less.

Example 18 can include, or can optionally be combined with the subject matter of Examples 1-17 to optionally include wherein one or more of the first or second composite materials includes a filament reinforced polymer having a modulus of elasticity of at least 7 million pounds per square inch.

Example 19 can include, or can optionally be combined with the subject matter of Examples 1-18 to optionally include wherein one or more of the first or second composite materials includes a filament reinforced polymer having a thermal conductivity between 3.0 to 4.0 (Btu in)/(hr ft$^{2}$° F.).

Example 20 can include, or can optionally be combined with the subject matter of Examples 1-19 to optionally include wherein the thermal isolation envelope includes a glazing clamp coupled with the panel frame, the glazing clamp includes a deflection arm engaged with the glazing unit at a clamp end.

Example 21 can include, or can optionally be combined with the subject matter of Examples 1-20 to optionally include wherein the metal glazing cap extends over and conceals the glazing clamp.

Example 22 can include, or can optionally be combined with the subject matter of Examples 1-21 to optionally include wherein the clamp end is a small profile clamp end including a polymer, and the small profile clamp end is engaged with the glazing unit with one or more of point or lineal contact.

Example 23 can include, or can optionally be combined with the subject matter of Examples 1-22 to optionally include wherein the thermal isolation envelope includes the small profile clamp end, and the small profile clamp end thermally isolates the unitary panel frame core including the hollow panel core wall from the glazing unit and the pane spacer.

Example 24 can include, or can optionally be combined with the subject matter of Examples 1-23 to optionally include wherein the fenestration assembly includes at least one of a door assembly or a window assembly.

Example 25 can include, or can optionally be combined with the subject matter of Examples 1-24 to optionally include wherein the frame core includes a core flange as part of the hollow panel core wall, the core flange extends to a flange end remote from the pane spacer.

Example 26 can include, or can optionally be combined with the subject matter of Examples 1-25 to optionally include wherein a flange plate of the core flange extends across a portion of the pane exterior surface and covers the at least one glazing unit edge and the pane spacer.

Example 27 can include, or can optionally be combined with the subject matter of Examples 1-26 to optionally include a mullion system along the peripheral frame core, the mullion system includes: a mullion recess extending along a stepped perimeter portion of the hollow peripheral core wall, and a mullion shoe within the mullion recess, wherein the mullion shoe includes a shoe surface flush with a stepped surface of the stepped perimeter portion.

Example 28 can include, or can optionally be combined with the subject matter of Examples 1-27 to optionally include wherein the mullion recess is a first mullion recess of a first fenestration assembly, and the mullion system includes: a mullion bridge configured for reception within the first mullion recess of the first fenestration assembly and a second mullion recess of a second fenestration assembly, and wherein the mullion bridge interconnects the first and second fenestration assemblies.

Example 29 can include, or can optionally be combined with the subject matter of Examples 1-28 to optionally include wherein the mullion system includes a mullion cap coupled between the first and second fenestration assemblies, and the mullion cap conceals the mullion bridge.

Example 30 can include, or can optionally be combined with the subject matter of Examples 1-29 to optionally include wherein one or more of the peripheral frame core or the unitary panel frame core is a pultruded frame core including a filament reinforced polymer.

Example 31 can include, or can optionally be combined with the subject matter of Examples 1-30 to optionally include a method of making a fenestration assembly comprising: assembling a fenestration frame with a frame core, assembling the fenestration frame includes: continuously forming the frame core from a base resin and filaments in the base resin, the frame core includes a core wall continuously extending between a core interior face and a core exterior face; cutting the frame core into two or more components of a fenestration frame; and assembling the two or more components into the fenestration frame; seating a glazing unit within the fenestration frame between the core interior face and the core exterior face, the glazing unit includes a glazing unit edge and a pane spacer proximate the glazing unit edge interposed between exterior and interior panes of the glazing unit; coupling a metal glazing cap with the frame core, the metal glazing cap includes a cap end positioned over the interior pane; and thermally isolating the pane spacer and the metal glazing cap from an environment exterior to the fenestration assembly with the core wall continuously extending between the core interior and exterior faces.

Example 32 can include, or can optionally be combined with the subject matter of Examples 1-31 to optionally include fastening the glazing unit within the fenestration frame with at least one glazing clamp.

Example 33 can include, or can optionally be combined with the subject matter of Examples 1-32 to optionally include wherein fastening the glazing unit within the fenestration frame includes: coupling a clamp base of the at least one glazing clamp with the frame core, engaging a clamp end of a deflection arm with the glazing unit, deflecting the deflection arm with engagement, and clamping the glazing unit between the frame core and the at least one glazing clamp according to the engaging and deflecting.

Example 34 can include, or can optionally be combined with the subject matter of Examples 1-33 to optionally include concealing the glazing clamp with the metal glazing cap coupled with the frame core, the glazing cap extends over the at least one glazing clamp.

Example 35 can include, or can optionally be combined with the subject matter of Examples 1-34 to optionally include wherein thermally isolating the pane spacer includes coupling a small profile clamp end with the glazing unit with one or more of point or lineal contact.

Example 36 can include, or can optionally be combined with the subject matter of Examples 1-35 to optionally include wherein thermally isolating the pane spacer and the metal glazing cap includes: directing heat transfer around the pane spacer and the metal glazing cap through the core wall and a core cavity within the core wall, and throttling the directed heat transfer through the core wall and the core cavity.

Example 37 can include, or can optionally be combined with the subject matter of Examples 1-36 to optionally include wherein continuously forming the frame core includes at least one of pultruding or extruding the base resin and filaments.

Example 38 can include, or can optionally be combined with the subject matter of Examples 1-37 to optionally include wherein continuously forming the frame core includes at least one of pultruding or extruding a urethane resin and glass filaments.

Example 39 can include, or can optionally be combined with the subject matter of Examples 1-38 to optionally include wherein continuously forming the frame core includes forming a core flange of the frame core, and a flange plate of the core flange extends from a remainder of the frame core to a flange end.

Example 40 can include, or can optionally be combined with the subject matter of Examples 1-39 to optionally include wherein seating the glazing unit within the fenestration frame includes seating the exterior pane of the glazing unit along the core flange.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the disclosure can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the disclosure should be determined with reference to the appended claims, along with the full scope of equivalents to which such claims are entitled.

What is claimed is:

1. A fenestration assembly comprising:

a fenestration frame having a frame core, wherein the frame core includes:

a core exterior face proximate an exterior of the fenestration assembly;

a core interior face proximate an interior of the fenestration assembly;

a core wall including a filament reinforced polymer, and the core wall extends continuously between the core exterior face and the core interior face; and one or more core cavities within the frame core, the one or more core cavities surrounded by the core wall;

wherein the frame core includes a modulus of elasticity of at least 7 million pounds per square inch and a thermal conductivity of 4.0 (Btu in)/(hr ft$^{2}$° F.) or less;

a glazing unit seated within the fenestration frame, the glazing unit between the core exterior face and the core interior face; and a glazing clamp coupled with the frame core, the glazing clamp configured to retain the glazing unit within the fenestration frame.

2. The fenestration assembly of claim 1, wherein the frame core is a unitary component including the filament reinforced polymer, and the frame core has a thermal conductivity between 3.0 to 4.0 (Btu in)/(hr ft$^{2}$° F.).

3. The fenestration assembly of claim 1, wherein the core wall extends continuously around the glazing unit and the core wall extends continuously from a glazing unit exterior to a glazing unit interior.

4. The fenestration assembly of claim 1, wherein the frame core is a pultruded frame core.

5. The fenestration assembly of claim 1, wherein the filament reinforced polymer is a glass filament reinforced polyurethane.

6. The fenestration assembly of claim 1, wherein a wall thickness of the core wall is between 0.06 and 0.150 inches.

7. The fenestration assembly of claim 1 comprising an insulation insert within the one or more core cavities.

8. The fenestration assembly of claim 7, wherein the insulation insert is coupled with the core wall.

9. The fenestration assembly of claim 1 comprising a plurality of metal components coupled with the core wall between the core interior face and the core exterior face, and the core wall thermally isolates each of the metal components of the plurality of metal components from each other.

10. The fenestration assembly of claim 9, wherein the plurality of metal components include a metal pane spacer of the glazing unit and a metal glazing cap.

11. The fenestration assembly of claim 1 comprising a peripheral frame having a peripheral frame core surrounding the fenestration frame, the peripheral frame core includes the filament reinforced polymer.

12. A fenestration assembly comprising:

a peripheral frame having a peripheral frame core, the peripheral frame core includes a hollow peripheral core wall including a composite material;

at least one panel movably coupled with the peripheral frame, the at least one panel includes:

a glazing unit seated within the at least one panel; and a frame core, the frame core having:

a core exterior face proximate an exterior of the fenestration assembly;

a core interior face proximate an interior of the fenestration assembly;

a core wall including a filament reinforced polymer, and the core wall extends continuously between the core exterior face and the core interior face; and one or more core cavities within the frame core, the one or more core cavities surrounded by the core wall;

wherein the frame core includes a modulus of elasticity of at least 7 million pounds per square inch and a thermal conductivity of 4.0 (Btu in)/(hr $ft^{2\circ}$ F.) or less.

13. The fenestration assembly of claim 12, wherein the frame core is a unitary component including the filament reinforced polymer, and the frame core has a thermal conductivity between 3.0 to 4.0 (Btu in)/(hr $ft^{2\circ}$ F.).

14. The fenestration assembly of claim 12, wherein the core wall extends continuously around the glazing unit and the core wall extends continuously from a glazing unit exterior to a glazing unit interior.

15. The fenestration assembly of claim 12, wherein the frame core is a pultruded frame core.

16. The fenestration assembly of claim 12, wherein the filament reinforced polymer is a glass filament reinforced polyurethane.

17. The fenestration assembly of claim 12, wherein a wall thickness of the core wall is between 0.06 and 0.150 inches.

18. The fenestration assembly of claim 12 comprising an insulation insert within the one or more core cavities.

19. The fenestration assembly of claim 18, wherein the insulation insert is coupled with the core wall.

20. The fenestration assembly of claim 12 comprising a plurality of metal components coupled with the core wall between the core interior face and the core exterior face, and the core wall thermally isolates each of the metal components of the plurality of metal components from each other.

21. The fenestration assembly of claim 20, wherein the plurality of metal components include a metal pane spacer of the glazing unit and a metal glazing cap.

22. A method of making a fenestration assembly comprising:

assembling a fenestration frame with a frame core, assembling the fenestration frame includes:

continuously forming the frame core from a base resin and filaments in the base resin, the frame core includes a core wall continuously extending between a core interior face and a core exterior face;

cutting the frame core into two or more components of a fenestration frame;

assembling the two or more components into the fenestration frame; and wherein the frame core includes a modulus of elasticity of at least 7 million pounds per square inch and a thermal conductivity of 4.0 (Btu in)/(hr $ft^{2\circ}$ F.) or less; and positioning a glazing unit within the fenestration frame between the core interior face and the core exterior face.

23. The method of claim 22, wherein continuously forming the frame core includes at least one of pultruding or extruding the base resin and filaments.

24. The method of claim 22, wherein the base resin includes a urethane resin and the filaments include glass filaments, and continuously forming the frame core includes at least one of pultruding or extruding the urethane resin and the glass filaments.

* * * * *